US010681969B2

(12) United States Patent
Deponte

(10) Patent No.: US 10,681,969 B2
(45) Date of Patent: Jun. 16, 2020

(54) LUGGAGE CASES

(71) Applicant: 24-7 International LLC, Pine Brook, NJ (US)

(72) Inventor: Christina Deponte, Cranford, NJ (US)

(73) Assignee: 24-7 International LLC, Pine Brook, NJ (US)

( * ) Notice: Subject to any disclaimer, the term of this patent is extended or adjusted under 35 U.S.C. 154(b) by 0 days.

(21) Appl. No.: 15/853,838

(22) Filed: Dec. 24, 2017

(65) Prior Publication Data

US 2018/0177271 A1 Jun. 28, 2018

Related U.S. Application Data

(60) Provisional application No. 62/439,003, filed on Dec. 24, 2016.

(51) Int. Cl.
*A45C 7/00* (2006.01)
*A45C 13/26* (2006.01)

(52) U.S. Cl.
CPC ..... *A45C 7/0036* (2013.01); *A45C 2013/267* (2013.01)

(58) Field of Classification Search
CPC ..... A45C 7/0036; A45C 2013/267
USPC ..... 190/107, 103, 106, 115; 383/2
See application file for complete search history.

(56) References Cited

U.S. PATENT DOCUMENTS 2,245,999 A 6/1941 Plotkin
2,301,549 A 11/1942 Herman
2,878,907 A 3/1959 Kivett
3,400,942 A 9/1968 Hull
3,960,252 A 6/1976 Cassimally
4,273,222 A 6/1981 Cassimally
4,895,230 A 1/1990 King
4,941,603 A * 7/1990 Creamer ..... A45F 3/04 150/109
5,484,046 A 1/1996 Alper
5,501,308 A 3/1996 King
5,547,052 A 8/1996 Latshaw
5,593,009 A 1/1997 King
(Continued)

OTHER PUBLICATIONS https://www.ebags.com/product/eagle-creek/ec-adventure-pop-top-carry-on/278361?productid=10316335.

*Primary Examiner* — Sue A Weaver
(74) *Attorney, Agent, or Firm* — Zhen Bao

(57) ABSTRACT

Provided herein is a luggage case having a first portion having a storage space, a second foldable portion having at least one expandable sleeve for transforming between a folded configuration and an expanded configuration, a separation member positioned between the first portion and the second foldable portion, the separation member separating the first and second portions such that when the second foldable portion is in the folded configuration the separation member prevents the second foldable portion from take away any storage space from the first portion. The luggage case may further have an extendable handle bar having at least one extendable bar, the extendable handle bar being connected to the first portion for pulling the luggage case, and an elastic handle connected to the second foldable portion and configured to accommodate the extendable handle bar such that when the second foldable portion is in the expanded configuration the elastic handle presses the extendable handle against the second foldable portion.

7 Claims, 4 Drawing Sheets

(56) References Cited

U.S. PATENT DOCUMENTS

| | | | | |
|---|---|---|---|---|
| 5,685,552 | A | 11/1997 | Osaki | |
| 6,015,072 | A * | 1/2000 | Young | A45C 7/0063 190/103 |
| 6,213,267 | B1 | 4/2001 | Miller | |
| 6,244,399 | B1 | 6/2001 | Birkestrand | |
| 6,776,271 | B2 * | 8/2004 | Chen | A45C 7/0027 190/107 |
| 7,232,018 | B1 * | 6/2007 | Salander | A45C 5/14 190/103 |
| 7,334,669 | B2 | 2/2008 | Barker | |
| 7,614,628 | B2 | 11/2009 | O'Connor | |
| 7,748,508 | B2 | 7/2010 | Lee | |
| 8,720,655 | B2 | 5/2014 | King | |
| 8,869,960 | B2 * | 10/2014 | Mangano | A45C 5/14 111/112 |
| 9,700,110 | B2 | 7/2017 | Lee | |
| 10,159,318 | B2 | 12/2018 | McGuire | |
| 2002/0153216 | A1 * | 10/2002 | Krulik | A45C 7/0027 190/103 |
| 2006/0260893 | A1 * | 11/2006 | Drew | A45C 5/14 190/108 |
| 2014/0097053 | A1 | 4/2014 | Huang | |
| 2015/0060221 | A1 * | 3/2015 | Bourette | A45C 5/14 190/18 A |
| 2017/0042302 | A1 * | 2/2017 | Farrelly | A45C 13/30 |

* cited by examiner

LUGGAGE CASES

REFERENCE TO RELATED APPLICATIONS

This application claims benefit of Application Ser. No. 62/439,003, filed Dec. 24, 2016. The entire contents of the above mentioned application is herein incorporated by reference.

SUBJECT OF THE INVENTION

The subject matter disclosed herein relates to luggage cases. More specifically, it is related to luggage cases that can function both as a carry-on luggage case and an under the seat type luggage case.

BACKGROUND OF INVENTION

The subject matter disclosed herein relates to luggage cases, specifically, it is related to luggage cases that may be carried onto commercial airplanes.

As luggage spaces can be limiting on today's commercial airplanes, the size of luggage cases one may bring onto a plane is also limited. Sometimes it may be desirable for one to bring only a luggage case that can be stored underneath a seat. But other times the same luggage case may be too small for the returning trip. One may try his best to anticipate his travel needs and bring multiple luggage cases, but such approach may be cumbersome and costly.

As such, there exists a need for luggage cases that can serve both as a larger carry on case and a smaller under the seat case.

SUMMARY OF INVENTION

The subject matter disclosed herein provides for a luggage case that having a first portion having a storage space, a second foldable portion having at least one expandable sleeve for transforming between a folded configuration and an expanded configuration, a separation member positioned between the first portion and the second foldable portion, the separation member separating the first and second portions such that when the second foldable portion is in the folded configuration the separation member prevents the second foldable portion from take away any storage space from the first portion. The luggage case may further have an extendable handle bar having at least one extendable bar, the extendable handle bar being connected to the first portion for pulling the luggage case, and an elastic handle connected to the second foldable portion and configured to accommodate the extendable handle bar such that when the second foldable portion is in the expanded configuration the elastic handle presses the extendable handle against the second foldable portion.

DETAILED DESCRIPTION

As indicated above, the subject matter presented herein provides for a luggage case that is capable of transforming between a under the seat type luggage case and a regular carrier on luggage case.

Figure 1:
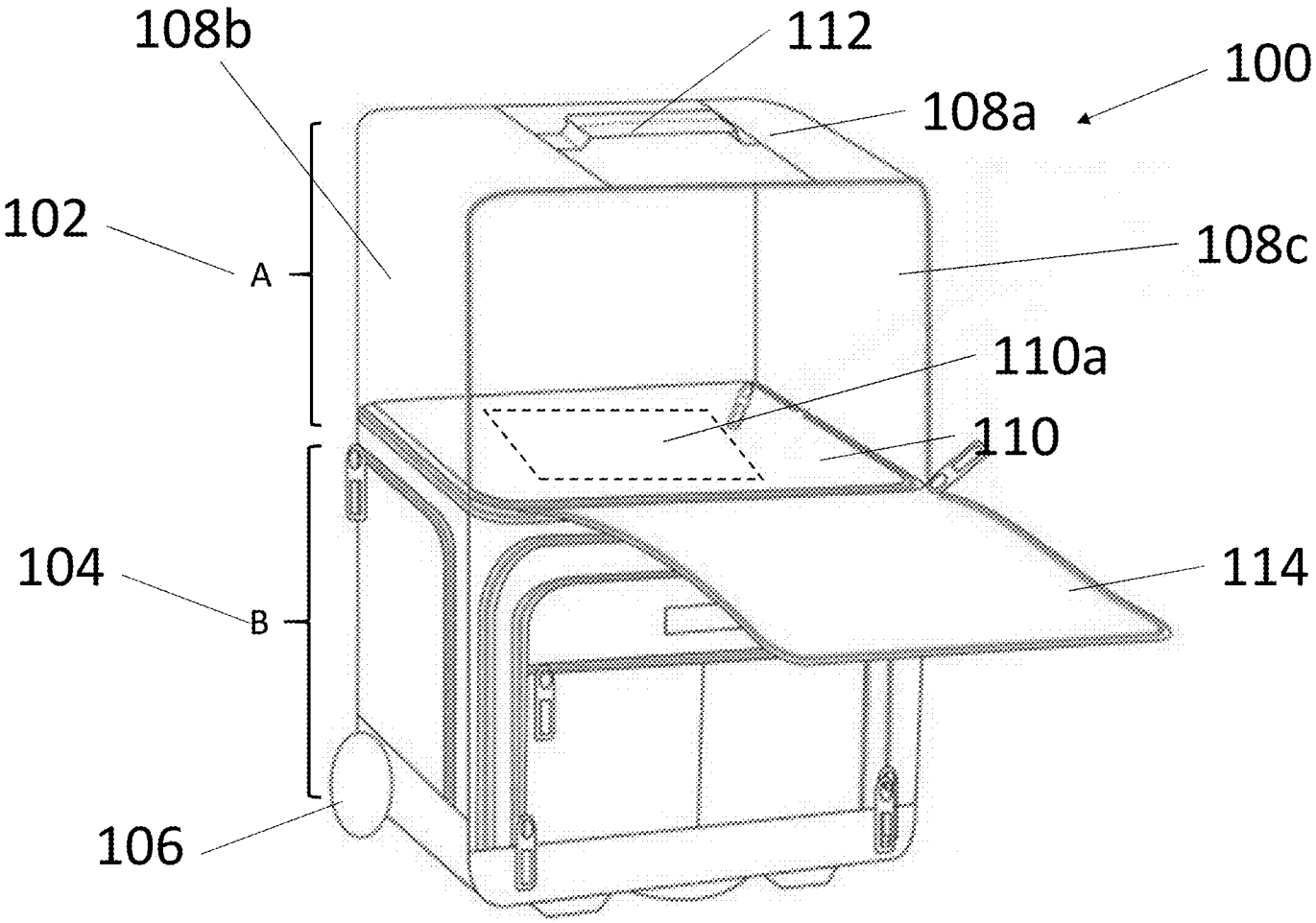
FIG. 1 illustrates a luggage case with an expandable portion in a fully expanded configuration in accordance with the subject matter presented herein.

FIG. 1 illustrates an exemplary embodiment of a luggage case 100 in accordance with the subject matter disclosed herein. This luggage case 100 may include a second portion A 102 that is collapsible or capable of being folded, and a first portion B 104 that's designed to function in a substantially rigid (i.e., not foldable) fashion. Normally, the first portion B 104 can have the size of an average luggage case that may be placed underneath a passenger's seat on a commercial airplane and designed to have the storage space that is comparable to an average under the seat luggage case. The first portion B 104 may assume a rectangular boxy shape in general (e.g., cubical in shape) or other geometric shapes commonly adopted in the industry, and portion B 104 may further have a pair of wheels 106 attached so the entire luggage case may be pulled or pushed easily. Referring now to the second portion A 102, when expanded as illustrated in FIG. 1, portion A 102 may have dimensions that's comparable to that of portion B 104 and together the two portions may form a luggage case that's comparable in size to a standard carry-on luggage case. In some embodiments, portion A 102 can include a cover portion 302 (shown in FIG. 3 below) with expandable sleeves 108*a*, 108*b*, 108*c* attached to the cover portion. When portion A 102 is in the folded or un-expanded configuration, the cover portion 302 will lay flat on top of portion B 104 and function as a top cover for portion B 104 and as well as for the entire luggage case. In contrast, when expanded, the cover portion 302 can open up perpendicularly by lifting up the cover portion 302 and rotate away from portion B 104 and the expandable sleeves 108*a*, 108*b*, 108*c* can unfold to create a compartment for extra storage spaces, as illustrated in FIG. 1. In this embodiment, the cover portion 302 is rectangular in general, and the expandable sleeves 108*a*, 108*b*, 108*c*, when unfolded, can form three walls to form a compartment for storing items. It should be appreciated that the cover portion 302 can easily adopt other geometric configurations and the resulting unfolded expandable sleeves 108*a*, 108*b*, 108*c* will accordingly form other geometric shaped compartment spaces. It a preferred embodiment, the cover portion 302 may be constructed of material that is more rigid and/or robust than the sleeves, as to provide protection against environmental elements to portion B 104 and the entire luggage case 100. In addition, not only the cover portion 302 can provide additional structural robustness to portion A 102 when it is expanded (as illustrated in FIG. 1), as the cover portion 302 lays substantially parallel with the back side of portion B 402 (as illustrated below in FIG. 4), the cover portion 302 also provides additional support to the luggage case 100 overall when portion A 102 is expanded, as it helps portion A 102 and the entire case 100 to stand rigid which facilitates the carrying and transportation of the case 100.

Figure 2:
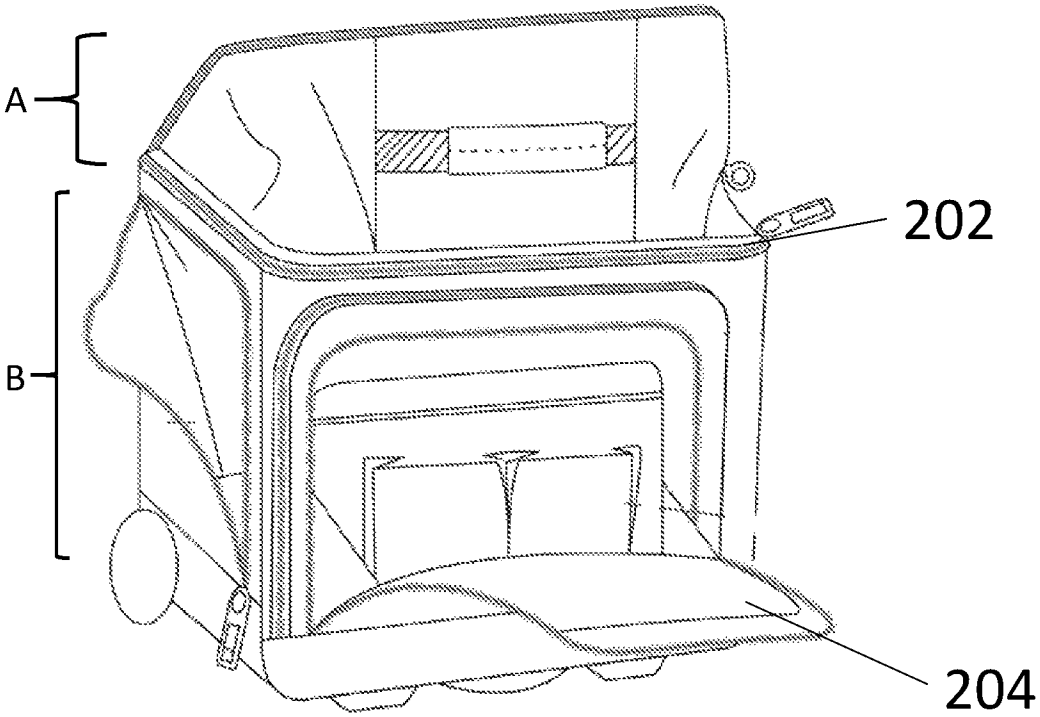
FIG. 2 illustrates the luggage case of FIG. 1 with the expandable portion in a partially expanded configuration in accordance with the subject matter presented herein.
Figure 3:
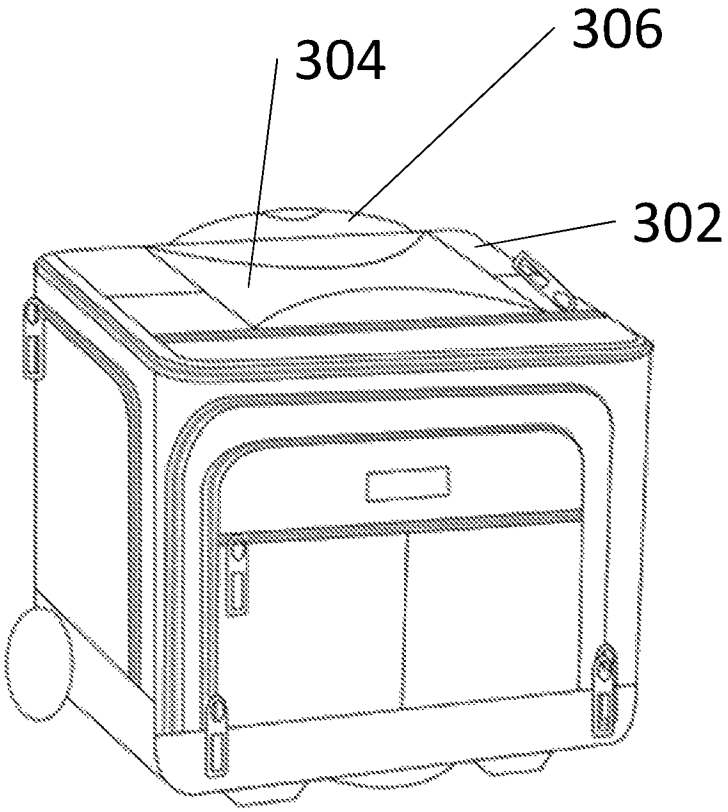
FIG. 3 illustrates the luggage case of FIG. 1 with the expandable portion in a folded configuration in accordance with the subject matter presented herein.

In some embodiments, the expandable compartment or portion A 102 folds completely within itself, as illustrated in FIGS. 2 and 3. Meaning, when unfolded, the expandable portion A 102 folds into itself and does not take up extra space from the main compartment portion B 104. Thereby leaving the main compartment completely available for storage. In use, the expandable sleeves 108*a*, 108*b*, 108*c* can fold and be tucked underneath the cover portion 302, as illustrated in FIG. 2, and the entire portion A 102, when folded up, is separated from portion B 104 by at least a separation member 110, as not to take up any space from portion B 104.

Furthermore, one portion of the expandable sleeves (e.g., portion 108*a*) may include a handling member 112 (e.g., a handle) for easy carrying of the luggage case when Portion A 102 is expanded. When portion A 102 is folded, this portion of the expandable sleeves 108*a*, 108*b*, 108*c* and the handling member 112 are folded underneath the cover portion 302 and sandwiched between the cover portion 302 and portion B 104, as illustrated in FIGS. 2 and 3. Portion A 102 of the luggage case 100 can also include a front cover 114 designed to provide closure to the newly formed Portion A 102 compartment space. This front cover 114 is also folded underneath the cover portion 302 when portion A 102 is in the un-expanded or folded configuration. When portion A 102 is expanded, this front cover 114 may be pulled out from underneath the cover portion 302 and together with a zipper or other locking mechanisms, the front cover 114 may be secured against the expandable sleeves (e.g., zipped up) to provide closure to the expanded portion A 102. It is preferred that the front cover 114 to be smaller in dimension than portion A 102 in its expanded configuration, such that front cover 114 in its entirety may be conveniently folded and stored under the cover portion 302 when portion A 102 is folded up. This design can be advantageous such that the entire expandable portion A 102 can be folded or collapsed all within itself and does not take away any storage space from portion B 104.

Normally, portions A 102 and B 104 of the luggage case can be separated by a separation member 110, which effectively creates two distinct storage compartments within the luggage case. However, in some embodiments, the separation member 110 may include a pass through portion 110*a*, allowing access between the two portions (e.g., portion A 102 and portion B 104). The pass through portion 110*a* may be closed or opened using a zipper and the size of the pass through can vary according to specific designs and/or needs. In some embodiments, the pass through portion may be of the same size as the separation member 110. In some other embodiment, the entire separation member 110 may be zipped on or off to allow passage between portions A 102 and B 104, in another word, the separation member 110 itself may function as the pass through portion when un-zipped from portion B 104. In use, when portion A 102 is folded down, the cover portion 302 will lay on top of the separation member 110, providing an extra layer of cover against environmental elements. In use, the separation member 110 separate the first portion B 104 and the second foldable portion A 102 such that when the second foldable portion A 102 is in the folded configuration the separation member prevents the second foldable portion A 102 from take away any storage space from the first portion B 104. In some embodiment, the pass through portion 110*a* on the separation member 110 may be left open during use such that luggage piece of long lengths may be placed across compartments A and B during travel.

FIG. 2 illustrates the portion A 102 in a partially expanded configuration in accordance with the subject matter presented herein. In use, the cover portion 302 of portion A 102 may be expanded away from portion B 104 by unzipping a zipper 202 connecting the cover portion 302 to the portion B 104. It should be appreciated that some locking mechanism commonly adopted in the field may be conveniently adopted to secure the cover portion 302 with the portion B 104. When lifted, the previously folded expandable sleeves 108*a*, 108*b*, 108*c* become unfolded and forms a compartment in conjunction with the top lid portion. Similarly, when being folded, the expandable sleeves 108*a*, 108*b*, 108*c* may be folded and tucked underneath the cover portion 302, and stored between the cover portion 302 and the separation member 110. In this fashion, the entire portion A 102 is collapsed or folded within itself, and take away no storage space from portion B 104.

In some embodiments, the substantially rigid portion B 104 can be designed to accommodate additional features such as pelican side pockets, front organizers and an oversize opening 204 to its main compartment, as illustrated in FIG. 2.

FIG. 3 illustrates the portion A 102 in a folded configuration in accordance with the subject matter presented herein. As illustrated in FIG. 3, when portion A 102 is folded, the luggage case 100 can assume a size that is comparable to a common underneath the seat carry-on luggage case. In this configuration, portion A 102 is completely folded, within itself, and is in a closed and collapsed position on top of portion B 104. Portion A's 102 cover portion 302 is also functioning as a lid or cover for portion B 104 and as well as the entire luggage case. In addition, the top lid portion of portion A 102 may include a handling member 304 that may be elastic as illustrated in FIG. 3. This handling member 304 can consist of material such that it can be stretched. In some embodiments, this handling member 304 may be substantially flat and can be stretched away from the cover portion 302 such that an extendable handle bar 306 may be inserted between the handling member 304 and the cover portion 302, when portion A 102 is in its expanded configuration, as illustrated below in FIG. 4. The handle bar 306 as illustrated here may include two bars, where the bars are designed to retract within themselves such that the overall length of the handle bar 306 may be varied. The overall size and geometric configuration of the handling member 304 may vary so long as it can accommodate the corresponding extendable handle bar 306. When portion A 102 is completed folded as illustrated in FIG. 3, the luggage case essentially functions as a stored under the seat luggage case.

Figure 4:
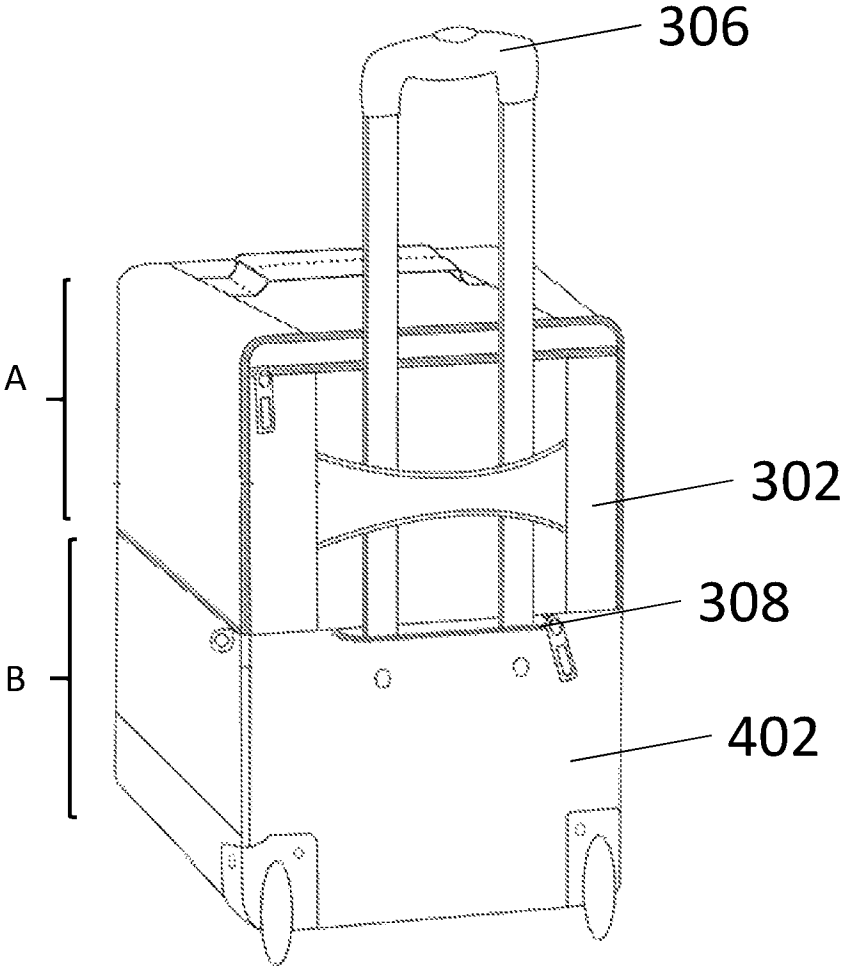
FIG. 4 illustrates a backside view of the luggage case presented in FIG. 1 in accordance with the subject matter presented herein.

FIG. 4 illustrates a backside view of the luggage case 100 with portion A 102 in a fully expanded configuration. In this configuration, the luggage case 100 is functioning as a regular carry on case, where portions A 102 and B 104 each providing comparable storage spaces. In some embodiments, portion B 104 may include an extendable handle bar 306 for easy pulling of the luggage case. In use, when portion A 102 is in its folded configuration, this handle bar 306 may be un-extended and stored in a zipped handle pocket 308 located on a back surface 402 of portion B 104, as illustrated in FIG. 3. However, when portion A 102 is expanded as illustrated in FIG. 4, portion A's 102 cover portion 302 is on a same planar surface as the back surface 402 of portion B 104, such that together they form a substantial planar back surface for the entire luggage case 100. In this configuration, the extendable handle bar 306 may be pulled out of the handle pocket 308 and extended between the handling member 304 and the cover portion 302. Since the handle member 304 is elastic, it will stretch and presses down onto the handle bar 306 and push it against the cover portion 302. Accordingly, the handle bar 306 is secured (e.g., pinned) against portion A's 102 cover portion 302 and provides additional structural support to portion A 102 when portion A 102 is in its expanded configuration.

Furthermore, this pressing down (or clamping/pinning) of the handle bar 306 against the expanded portion A 102 also provides extra robustness to the luggage case as a whole, where the two bars of the handling bar 306 are securely positioned between the handling member 304 and the cover portion 302, preventing any substantial later or vertical movement of portion A 102, as well as providing a pivot position to exert force to portion A 102 during pulling of the luggage case 100, thereby improving the luggage case's performance in use.

From the foregoing, it will be seen that the present invention provides for a luggage case that can transform its overall shape and storage spaces in a convenient fashion. Because the transformation between different configurations is done by expanding or folding an expandable portion of the luggage case, there is no need for attaching additional components to the luggage case.

It will be apparent to those skilled in the art that numerous changes and modifications can be made in the specific embodiments of the invention described above without departing from the scope of the invention. Accordingly, the whole of the foregoing description is to be interpreted in an illustrative and not in a limitative sense.

The invention claimed is:

1. A luggage case comprising:

a first portion having a storage space;

a second foldable portion having at least one expandable sleeve for transforming between a folded configuration and an expanded configuration;

a separation member positioned between the first portion and the second foldable portion, the separation member separating the first and second portions such that when the second foldable portion is in the folded configuration the separation member prevents the second foldable portion from taking away any storage space from the first portion;

an extendable handle bar having at least one extendable bar, the extendable handle bar being connected to the first portion for pulling the luggage case;

an elastic handle connected to the second foldable portion and configured to accommodate the extendable handle bar such that when the second foldable portion is in the expanded configuration the elastic handle presses the extendable handle against the second foldable portion, the elastic handle serves as the elastic handle to the luggage case when the second foldable portion is in the folded configuration; and a second handling member attached to the at least one expandable sleeve and configured to serve as a second handle to the luggage when the second foldable portion is in the expanded configuration, and configured to be folded underneath the elastic handle when the second foldable portion is in the folded configuration.

2. The luggage case of claim 1 where the separation member further comprising a pass through.

3. The luggage case of claim 1 further comprising a set of wheels for easy pulling of the luggage case.

4. The luggage case of claim 1, wherein expandable sleeves form three walls when the foldable portion is in the expanded configuration.

5. The luggage case of claim 1, wherein the foldable portion is substantially rectangular.

6. The luggage case of claim 1 further comprising a pass through between the first portion and the second foldable portion, the pass through configured to accommodate the placement of items across the first portion and the second foldable portion.

7. The luggage case of claim 1 further comprising one of a pelican side pocket, a front organizer or an oversize opening to main compartment.

* * * * *